US010217432B2

(12) United States Patent
Park et al.

(10) Patent No.: US 10,217,432 B2
(45) Date of Patent: Feb. 26, 2019

(54) GATE DRIVING CIRCUIT AND DISPLAY DEVICE INCLUDING THE SAME

(71) Applicant: Samsung Display Co., Ltd., Yongin-si, Gyeonggi-do (KR)

(72) Inventors: Junhyun Park, Suwon-si (KR); Sunghwan Kim, Yongin-si (KR); Kyoungju Shin, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 282 days.

(21) Appl. No.: 15/247,896

(22) Filed: Aug. 25, 2016

(65) Prior Publication Data

US 2017/0186394 A1 Jun. 29, 2017

(30) Foreign Application Priority Data

Dec. 28, 2015 (KR) ..... 10-2015-0187738

(51) Int. Cl.
*G09G 3/36* (2006.01)

(52) U.S. Cl.
CPC ..... *G09G 3/3688* (2013.01); *G09G 3/3677* (2013.01); *G09G 3/3696* (2013.01); *G09G 2300/0426* (2013.01); *G09G 2300/0452* (2013.01); *G09G 2310/0286* (2013.01); *G09G 2310/08* (2013.01); *G09G 2320/0214* (2013.01)

(58) Field of Classification Search
CPC ..... G09G 2310/0286; G09G 3/3677; G09G 2310/0267; G09G 3/3266; G09G 3/3674
See application file for complete search history.

(56) References Cited

U.S. PATENT DOCUMENTS

| | | | | |
|---|---|---|---|---|
| 7,499,518 | B2 | 3/2009 | Tobita et al. | |
| 8,462,097 | B2 | 6/2013 | Kim et al. | |
| 9,019,187 | B2 | 4/2015 | Moon et al. | |
| 9,087,468 | B2 | 7/2015 | Yoon et al. | |
| 9,218,074 | B2 | 12/2015 | Cho et al. | |
| 2013/0113772 | A1* | 5/2013 | Kang | G09G 3/20 345/211 |
| 2016/0042806 | A1* | 2/2016 | Ogawa | G11C 19/28 345/205 |
| 2016/0189659 | A1* | 6/2016 | Park | G11C 19/287 345/87 |

FOREIGN PATENT DOCUMENTS

| | | |
|---|---|---|
| KR | 10-0608885 | 8/2006 |
| KR | 10-2007-0082414 | 8/2007 |
| KR | 10-0863502 | 10/2008 |
| KR | 10-1115026 | 3/2012 |

(Continued)

*Primary Examiner* — Koosha Sharifi-Tafreshi
(74) *Attorney, Agent, or Firm* — Lewis Roca Rothgerber Christie LLP

(57) ABSTRACT

A gate driving circuit in a display device includes a plurality of stages connected in cascade. An ith stage from among the plurality of stages includes a first output unit, a control unit, a pull-down unit, and an inverter unit. The first output unit includes a first output transistor including a first control electrode, a second control electrode overlapping with the first control electrode, an input electrode, and an output electrode. A signal outputted from an inverter unit of an i−1th stage is applied to the second control electrode.

20 Claims, 12 Drawing Sheets

(56) References Cited

FOREIGN PATENT DOCUMENTS

| | | |
|---|---|---|
| KR | 10-2012-0091881 | 8/2012 |
| KR | 10-2014-0042308 | 4/2014 |
| KR | 10-2015-0069317 | 6/2015 |
| KR | 10-2015-0069787 | 6/2015 |
| KR | 10-1573460 | 12/2015 |

* cited by examiner

GATE DRIVING CIRCUIT AND DISPLAY DEVICE INCLUDING THE SAME

CROSS-REFERENCE TO RELATED APPLICATION

This application claims priority to and the benefit of Korean Patent Application No. 10-2015-0187738, filed on Dec. 28, 2015, in the Korean Intellectual Property Office (KIPO), the entire content of which in its entirety is herein incorporated by reference.

BACKGROUND

1. Field of Disclosure

One or more aspects of example embodiments of the present disclosure relate to a driving circuit and a display device including the same, and more particularly, to a small-sized gate driving circuit and a display device having a thin bezel.

2. Description of the Related Art

A display device includes a plurality of gate lines, a plurality of data lines, and a plurality of pixels connected to the plurality of gate lines and the plurality of data lines. The display device includes a gate driving circuit for sequentially providing gate signals to the plurality of gate lines, and a data driving circuit for outputting data signals to the plurality of data lines.

The gate driving circuit includes one shift register formed of a plurality of stages connected in cascade to each other. Each of the plurality of stages includes a plurality of transistors that are operatively connected to each other to output a gate voltage to a corresponding gate line.

Recently, the resolution of a display device is increased from Full High Definition (FHD) that supports 1920×1080 resolution to Ultra High Definition (UHD) that supports 7680×4320 resolution (8K) or 3840×2160 resolution (4K), so that the resolution of the display device becomes higher.

The above information disclosed in this Background section is for enhancement of understanding of the background of the inventive concept, and therefore, it may contain information that does not constitute prior art.

SUMMARY

One or more aspects of example embodiments of the present disclosure provide a gate driving circuit for controlling a gate signal with (e.g., only with) an output transistor of a double gate structure, even if there is no additional transistor for pulling-down or holding the gate signal, and a display device including the same.

According to an example embodiment of the inventive concept, a gate driving circuit includes a plurality of stages configured to output gate signals to gate lines, respectively, and connected to each other in cascade, an ith stage, where i is an integer greater than or equal to two, from among the plurality of stages including: a first output unit including a first output transistor including a first control electrode, a second control electrode overlapping with the first control electrode, an input electrode, and an output electrode, the first output unit being configured to generate a gate signal having a gate-off voltage lower than a gate-on voltage from a first clock signal applied to the input electrode of the first output transistor in response to a second signal applied to the second control electrode of the first output transistor to output a gate signal to the output electrode of the first output transistor and to maintain the gate signal at the gate-off voltage, after the gate signal having the gate-on voltage is outputted to the output electrode of the first output transistor from the first clock signal applied to the input electrode of the first output transistor in response to a first signal applied to the first control electrode of the first output transistor; a control unit configured to control a voltage of a first node connected to the first control electrode of the first output transistor; and an inverter unit configured to output, to a second node, an inverter signal that swings between an inverter-low voltage and an inverter-high voltage higher than the inverter-low voltage, when the gate signal having the gate-on voltage is outputted from the first output unit to allow a voltage of the inverter signal to be at the inverter-low voltage, and when the gate signal having the gate-off voltage is outputted from the first output unit in response to the second signal to allow the voltage of the inverter signal to be at the inverter-high voltage.

In an embodiment, the second signal may be an inverter signal outputted from an inverter unit of an i+1th stage.

In an embodiment, the inverter unit of the ith stage may include an inverter transistor, the inverter transistor including: a control electrode configured to receive an gate signal outputted from a first output unit of an i+1th stage; an input electrode configured to receive a second clock signal having a phase difference of 180° with respect to the first clock signal; and an output electrode connected to the second node.

In an embodiment, the ith stage may further include a second output unit including a second output transistor, the second output transistor including: a control electrode connected to the first node; an input electrode configured to receive the first clock signal; and an output electrode configured to output, to a carry output terminal of the ith stage, a carry signal having a carry-on voltage generated from the first clock signal.

In an embodiment, the ith stage may further include a pull-down unit configured to provide a carry-off voltage lower than the carry-on voltage to the carry output terminal of the ith stage after the carry signal having the carry-on voltage is outputted.

In an embodiment, the gate-off voltage may be higher than the carry-off voltage.

In an embodiment, the gate-off voltage may be higher than about −15 V and lower than about −13 V, and the carry-off voltage may be higher than about −17 V and lower than about −15 V.

In an embodiment, the inverter unit of the ith stage may include an inverter transistor, the inverter transistor including: a control electrode configured to receive a carry signal outputted from a second output unit of an i+1th stage; an input electrode configured to receive a second clock signal having a phase difference of 180° with respect to the first clock signal; and an output electrode connected to the second node.

In an embodiment, the gate-off voltage may be higher than the carry-off voltage.

In an embodiment, the gate-off voltage may be substantially equal to the carry-off voltage.

In an embodiment, the control unit may include a first control transistor, a second control transistor, a third control transistor, and a fourth control transistor, and the first control transistor may include a control electrode configured to receive an carry signal outputted from a second output unit of an i−1th stage, an input electrode configured to receive a second clock signal having a phase difference of 180° with respect to the first clock signal, and an output electrode connected to an input electrode of the second control transistor; the second control transistor may include a control electrode connected to the control electrode of the first control transistor, the input electrode connected to the output electrode of the first control transistor, and an output electrode connected to the first node; the third control transistor may include a control electrode connected to the second node, an input electrode connected to an output electrode of the fourth control transistor, and an output electrode connected to the first node; and the fourth control transistor may include a control electrode connected to the control electrode of the third control transistor, an input electrode configured to receive a voltage that is substantially equal to the inverter-low voltage, and the output electrode connected to the input electrode of the third control transistor.

In an embodiment, the ith stage may further include a leakage current prevention unit including a leakage current prevention transistor, the leakage current prevent transistor including: a control electrode connected to the output electrode of the second output transistor; an input electrode connected to the control electrode of the leakage current prevention transistor; and an output electrode connected to the output electrode of the first control transistor and to the output electrode of the fourth control transistor.

According to an example embodiment of the inventive concept, a display device includes: a display panel including a plurality of gate lines, a plurality of data lines crossing and insulated from the plurality of gate lines, and a plurality of pixels respectively connected to corresponding gate lines and corresponding data lines; a data driver configured to provide data signals to the plurality of data lines; and a gate driver including a plurality of stages connected in cascade to each other and configured to provide gate signals to the plurality of gate lines, an ith stage, where i is an integer greater than or equal to two, from among the plurality of stages including: a first output unit including a first output transistor including a first control electrode, a second control electrode overlapping with the first control electrode, an input electrode, and an output electrode, the first output unit being configured to generate a gate signal having a gate-off voltage lower than a gate-on voltage from a first clock signal applied to the input electrode of the first output transistor in response to a second signal applied to the second control electrode of the first output transistor to output a gate signal to the output electrode of the first output transistor and to maintain the gate signal at the gate-off voltage, after the gate signal having the gate-on voltage is outputted to the output electrode of the first output transistor from the first clock signal applied to the input electrode of the first output transistor in response to a first signal applied to the first control electrode of the first output transistor; a control unit configured to control a voltage of a first node connected to the first control electrode of the first output transistor; and an inverter unit configured to output, to a second node, an inverter signal that swings between an inverter-low voltage and an inverter-high voltage higher than the inverter-low voltage, when the gate signal having the gate-on voltage is outputted from the first output unit to allow a voltage of the inverter signal to be at the inverter-low voltage, and when the gate signal having the gate-off voltage is outputted from the first output unit in response to the second signal to allow the voltage of the inverter signal to be at the inverter-high voltage.

In an embodiment, the second signal may be an inverter signal outputted from an inverter unit of an i+1th stage.

In an embodiment, the inverter unit of the ith stage may include an inverter transistor, the inverter transistor including: a control electrode configured to receive an gate signal outputted from a first output unit of an i+1th stage; an input electrode configured to receive a second clock signal having a phase difference of 180° with respect to the first clock signal; and an output electrode connected to the second node.

In an embodiment, the ith stage may further include a second output unit including a second output transistor, the second output transistor including: a control electrode connected to the first node; an input electrode configured to receive the first clock signal; and an output electrode configured to output, to a carry output terminal of the ith stage, a carry signal having a carry-on voltage generated from the first clock signal.

In an embodiment, the ith stage may further include a pull-down unit configured to provide a carry-off voltage lower than the carry-on voltage to the carry output terminal of the ith stage after the carry signal having the carry-on voltage is outputted.

In an embodiment, the gate-off voltage may be higher than the carry-off voltage.

In an embodiment, the gate-off voltage may be higher than about −15 V and lower than about −13 V, and the carry-off voltage may be higher than about −17 V and lower than about −15 V.

According to an example embodiment of the inventive concept, a gate driving circuit includes a plurality of stages configured to output gate signals to gate lines, respectively, and connected in cascade with each other, each of the plurality of stages including an output transistor, an inverter transistor, and a control transistor, and an output transistor of one stage from among the plurality of stages including: a first control electrode electrically connected to a first node of the one stage; a second control electrode electrically connected to an output electrode of an inverter transistor of a previous stage of the one stage; an input electrode configured to receive a first clock signal that swings between a first clock voltage and a second clock voltage; and an output electrode configured to transfer a gate signal generated from the first clock signal. An inverter transistor of the one stage includes: a control electrode electrically connected to an output electrode of an output transistor of the next stage of the one stage; an input electrode configured to receive a second clock signal having a phase difference of 180° with respect to the first clock signal; and an output electrode electrically connected to a second control electrode of the output transistor of the next stage, and a control transistor of the one stage includes: a control electrode electrically connected to an output electrode of an output transistor of the previous stage; an input electrode configured to receive the second clock signal; and an output electrode electrically connected to the first node.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept, and together with the description, serve to explain aspects and features of the inventive concept. In the drawings.

DETAILED DESCRIPTION

Figure 1:
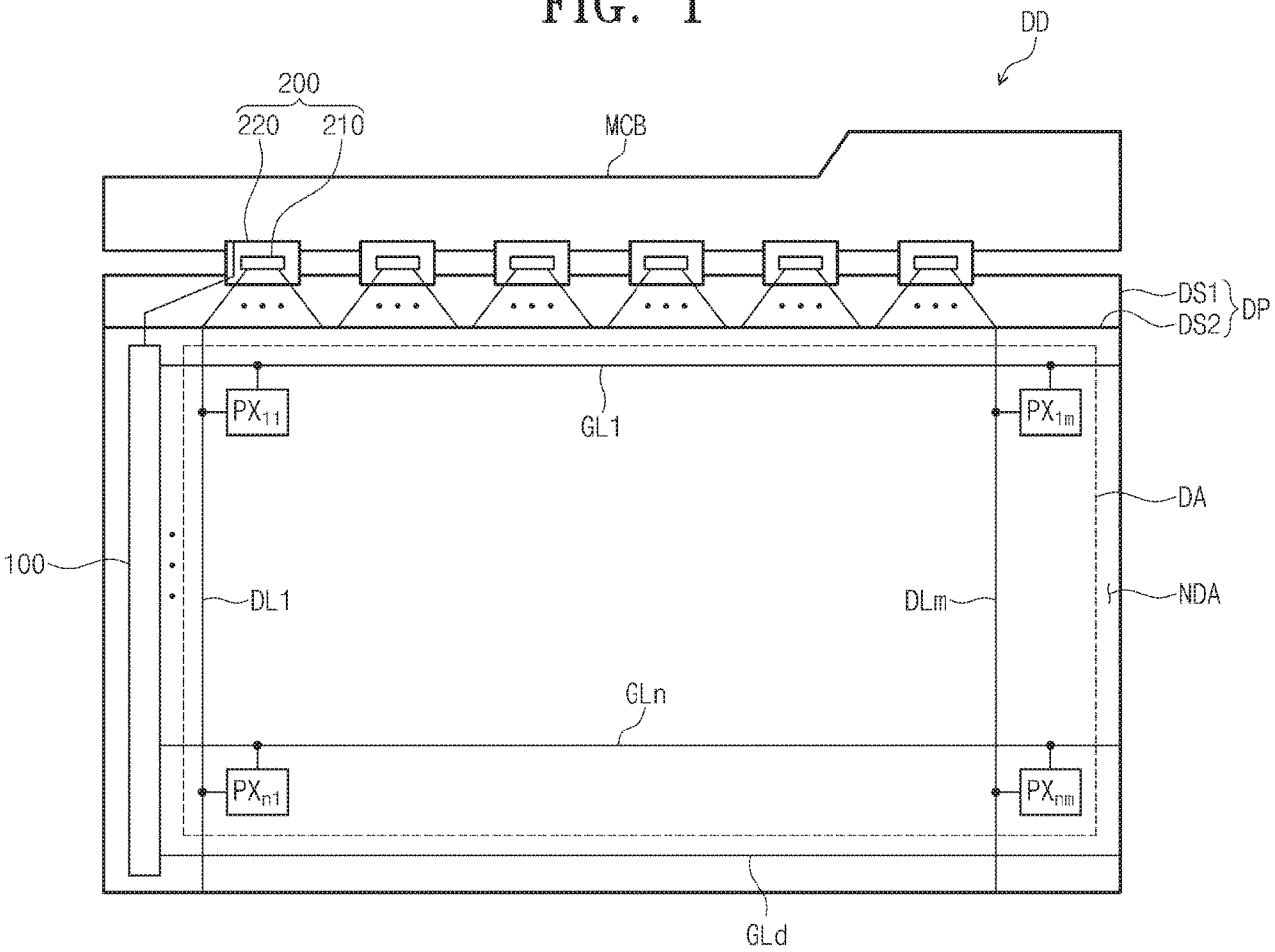
FIG. 1 is a block diagram illustrating a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
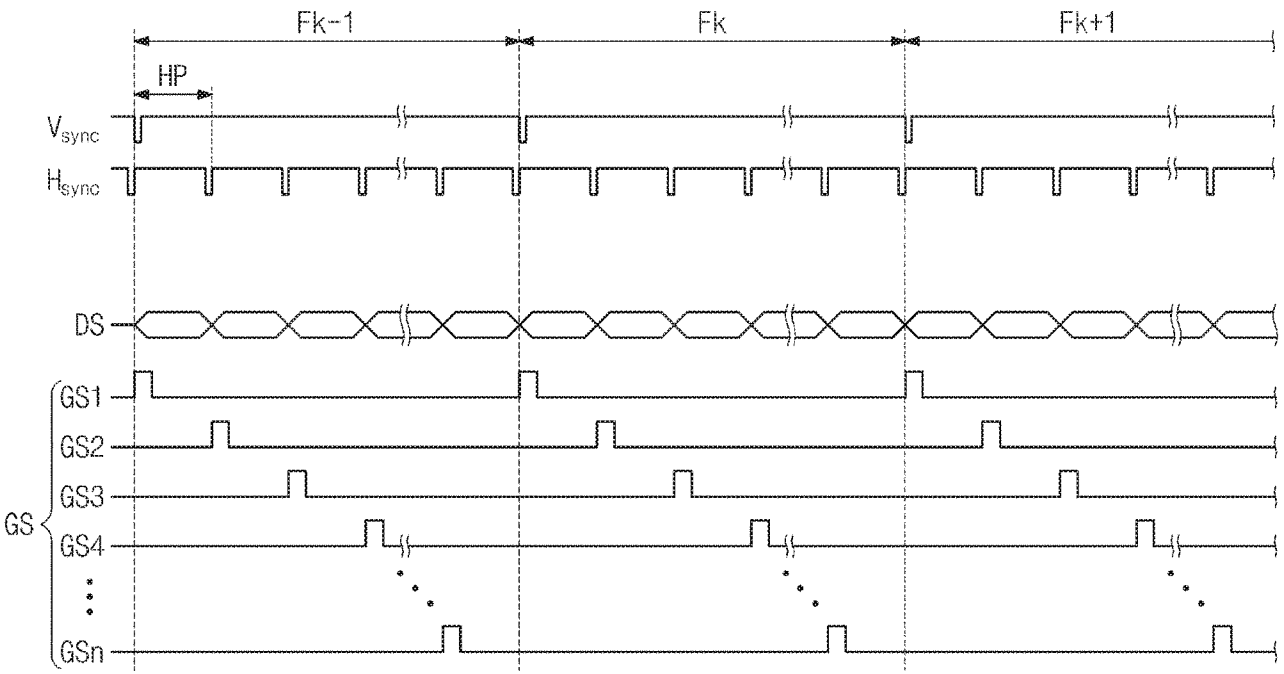
FIG. 2 is a timing diagram illustrating signals of a display device according to an embodiment of the inventive concept.

FIG. 1 is a plan view of a display device according to an embodiment of the inventive concept. FIG. 2 is a timing diagram illustrating signals of a display device according to an embodiment of the inventive concept.

As shown in FIGS. 1 and 2, a display device according to an embodiment of the inventive concept includes a display panel DP, a gate driving circuit (e.g., a gate driver) 100, and a data driving circuit (e.g., a data driver) 200.

The display panel DP is not limited to a specific embodiment of the inventive concept and may include various display panels, such as a liquid crystal display panel, an organic light emitting display panel, an electrophoretic display panel, and/or an electrowetting display panel. For convenience, the display panel DP is described as a liquid crystal display panel. When the display panel DP includes a liquid crystal display panel, the liquid crystal display device including the liquid crystal display panel may further include a polarizer and a backlight unit (e.g., a backlight source).

The display panel DP includes a first substrate DS1, a second substrate DS2 spaced from the first substrate DS1, and a liquid crystal layer LCL disposed between the first substrate DS1 and the second substrate DS2. On a plane, the display panel DP includes a display area DA including a plurality of pixels PX11 to PXnm, and a non-display area NDA surrounding the display area DA.

The display panel DP includes a plurality of gate lines GL1 to GLn disposed on the first substrate DS1, and a plurality of data lines DL1 to DLm crossing the plurality of gate lines GL1 to GLn. The plurality of gate lines GL1 to GLn are connected to the gate driving circuit 100. The plurality of data lines DL1 to DLm are connected to the data driving circuit 200. For convenience, some of the plurality of gate lines GL1 to GLn and some of the plurality of data lines DL1 to DLm are illustrated in FIG. 1. Additionally, the display panel DP may further include a dummy gate line GLd disposed in the non-display area NDA of the first substrate DS1.

For convenience, some of the plurality of pixels PX11 to PXnm are illustrated in FIG. 1. The plurality of pixels PX11 to PXnm are respectively connected to corresponding gate lines from among the plurality of gate lines GL1 to GLn and corresponding data lines from among the plurality of data lines DL1 to DLm. However, the dummy gate line GLd may not be connected to the plurality of pixels PX11 to PXnm.

The plurality of pixels PX11 to PXnm may be divided into a plurality of groups according to a color to be displayed. The plurality of pixels PX11 to PXnm may display any one of primary colors. The primary colors may include red, green, blue, and/or white. However, the inventive concept is not limited thereto, and thus, the primary colors may further include (or alternatively include) various colors, such as yellow, cyan, magenta, etc.

The gate driving circuit 100 and the data driving circuit 200 receive a control signal from a signal control unit (e.g., a signal controller, for example, a timing controller). The signal control unit may be mounted on a main circuit board MCB. The signal control unit receives image data and control signals from an external graphic control unit (e.g., an external graphic controller). The control signals may include vertical sync signals Vsync that are signals for distinguishing frame sections Fk−1, Fk, and Fk+1, horizontal sync signals Hsync that are signals for distinguishing horizontal sections HP (e.g., row distinction signals), data enable signals (that may be, for example, in high level only during a section where data is outputted to display a data incoming area), and clock signals.

The gate driving circuit 100 generates gate signals GS1 to GSn on the basis of a control signal (hereinafter referred to as a gate control signal) received from the first signal control unit during frame sections Fk−1, Fk, and Fk+1, and outputs the gate signals GS1 to GSn to the plurality of gate lines GL1 to GLn. The gate signals GS1 to GSn may be sequentially outputted in correspondence to the horizontal sections HP. The gate driving circuit 100 and the pixels PX11 to PXnm may be formed concurrently (e.g., simultaneously) through a thin film process. For example, the gate driving circuit 100 may be mounted in an Amorphous Silicon TFT Gate driver circuit (ASG) form or an Oxide Semiconductor TFT Gate driver circuit (OSG) form at (e.g., in) the non-display area NDA.

FIG. 1 illustrates one gate driving circuit 100 connected to the left ends of the plurality of gate lines GL1 to GLn. However, the inventive concept is not limited thereto, for example, according to an embodiment of the inventive concept, a display device may include two gate driving circuits. One of the two gate driving circuits may be connected to the left ends of the plurality of gate lines GL1 to GLn and the other one of the two may be connected to the right ends of the plurality of gate lines GL1 to GLn. Additionally, one of the two gate driving circuits may be connected to odd gate lines and the other one of the two may be connected to even gate lines.

The data driving circuit 200 generates gray level voltages according to image data provided from the signal control unit on the basis of a control signal (hereinafter referred to as a data control signal) received from the signal control unit. The data driving circuit 200 outputs the gray level voltages as data voltages DS to the plurality of data lines DL1 to DLm.

The data voltages DS may include positive data voltages each having a positive value with respect to a common voltage, and/or negative data voltages each having a negative value with respect to the common voltage. Some of data voltages applied to the data lines DL1 to DLm may each have a positive polarity and others may each have a negative polarity during each of the horizontal sections HP. The polarity of the data voltages DS may be inverted according to the frame sections Fk−1, Fk, and Fk+1, in order to prevent or reduce the deterioration of liquid crystals. The data driving circuit 200 may generate data voltages inverted by each frame section unit in response to an invert signal.

The data driving circuit 200 may include a driving chip 210 and a flexible circuit board 220 on which the driving chip 210 is mounted. The data driving circuit 200 may include a plurality of driving chips 210 and a plurality of flexible circuit boards 220. The flexible circuit board 220 connects (e.g., electrically connects) the main circuit board MCB and the first substrate DS1. The plurality of driving chips 210 provide data signals to corresponding data lines from among the plurality of data lines DL1 to DLm.

FIG. 1 illustrates a Tape Carrier Package (TCP) type (form) data driving circuit 200, as an example. However, the inventive concept is not limited thereto, for example, according to an embodiment of the inventive concept, the data driving circuit 200 may be disposed at (e.g., in) the non-display area NDA of the first substrate DS1 through a Chip on Glass (COG) method.

Figure 3:
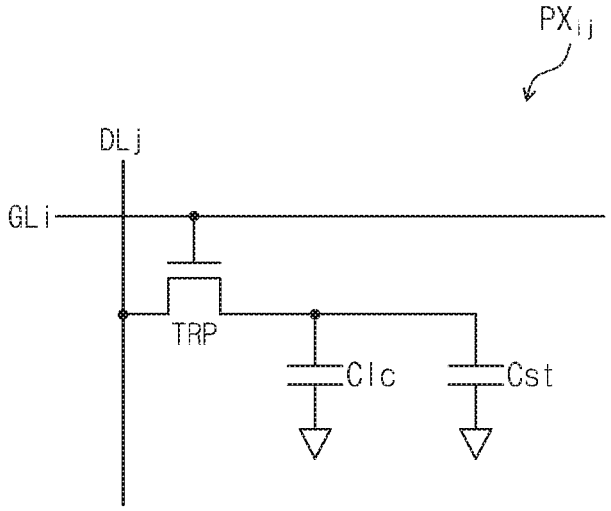
FIG. 3 is an equivalent circuit diagram of a pixel according to an embodiment of the inventive concept.
Figure 4:
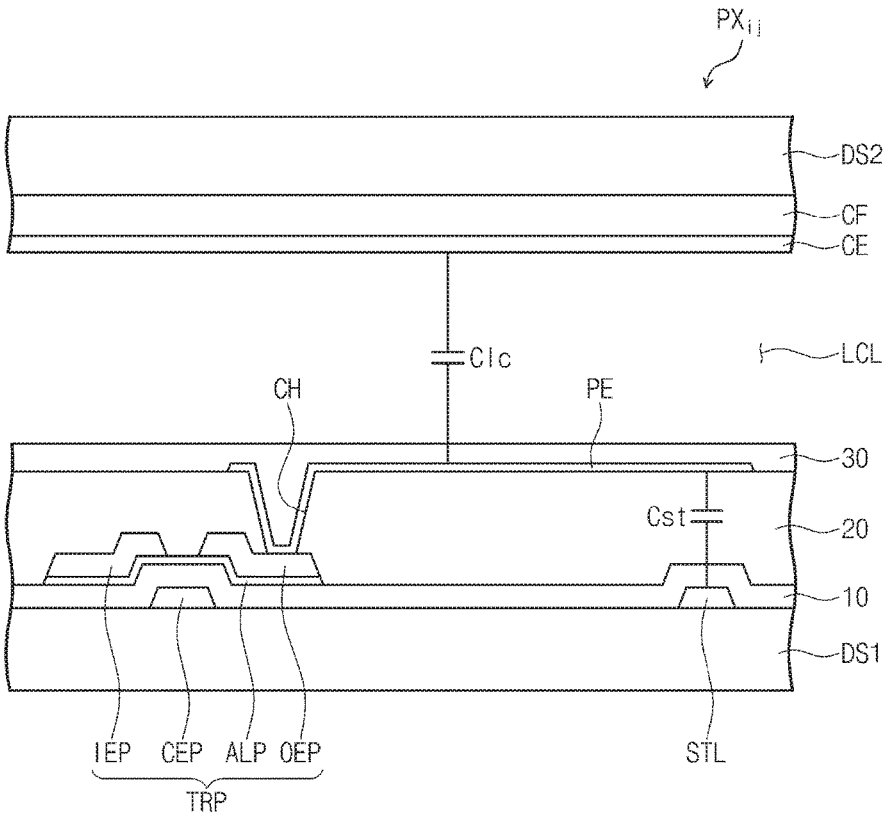
FIG. 4 is a sectional view of a pixel according to an embodiment of the inventive concept.

FIG. 3 is an equivalent circuit diagram of a pixel PXij according to an embodiment of the inventive concept. FIG. 4 is a sectional view of a pixel PXij according to an embodiment of the inventive concept. Each of the plurality of pixels PX11 to PXnm shown in FIG. 1 may have the same or substantially the same circuit as that shown in FIG. 3.

As shown in FIG. 3, the pixel PXij includes a pixel thin film transistor (hereinafter referred to as a pixel transistor) TRP, a liquid crystal capacitor Clc, and a storage capacitor Cst. According to an embodiment of the inventive concept, the storage capacitor Cst may be omitted.

The pixel transistor TRP is electrically connected to an ith gate line GLi and a jth data line DLj. The pixel transistor TRP outputs a pixel voltage corresponding to a data signal received from the jth data line DLj in response to a gate signal received from the ith gate line GLi.

The liquid crystal capacitor Clc charges a pixel voltage outputted from the pixel transistor TRP. An arrangement of liquid crystal directors included in the liquid crystal layer LCL (see FIG. 4) is changed according to a charge amount charged in the liquid crystal capacitor Clc. The light incident to the liquid crystal layer LCL may be transmitted or blocked according to an arrangement of the liquid crystal directors.

The storage capacitor Cst is connected in parallel to the liquid crystal capacitor Clc. The storage capacitor Cst maintains or substantially maintains an arrangement of the liquid crystal directors during a set or predetermined section.

As shown in FIG. 4, the pixel transistor TRP includes a control electrode CEP (hereinafter referred to as a pixel control electrode) connected to the ith gate line GLi (see FIG. 3), an activation layer ALP (hereinafter referred to as a pixel activation layer) overlapping with the pixel control electrode CEP, an input electrode IEP (hereinafter referred to as a pixel input electrode) connected to the jth data line DLj (see FIG. 3), and an output electrode OEP spaced from the pixel input electrode IEP.

The liquid crystal capacitor Clc includes a pixel electrode PE and a common electrode CE. The storage capacitor Cst includes the pixel electrode PE and a portion of a storage line STL overlapping with the pixel electrode PE.

The ith gate line GLi and the storage line STL are disposed on a surface (e.g., one surface) of the first substrate DS1. The pixel control electrode CEP is branched from the ith gate line GLi. The ith gate line GLi and the storage line STL may include a metal (for example, Al, Ag, Cu, Mo, Cr, Ta, Ti, etc.) or an alloy thereof. The ith gate line GLi and the storage line STL may have a multi-layer structure, and for example, may include a Ti layer and a Cu layer.

A first insulating layer 10 covering the pixel control electrode CEP and the storage line STL is disposed on a surface (e.g., one surface) of the first substrate DS1. The first insulating layer 10 may include at least one of an inorganic material and an organic material. The first insulating layer 10 may be an organic and/or inorganic layer. The first insulating layer 10 may have a multi-layer structure, and for example, may include a silicon nitride layer and a silicon oxide layer.

The activation layer ALP overlapping the pixel control electrode CEP is disposed on the first insulating layer 10. The pixel activation layer ALP may include a semiconductor layer and an ohmic contact layer.

The pixel activation layer ALP may include amorphous silicon or poly silicon. Additionally, the pixel activation layer ALP may include a metal oxide semiconductor.

The pixel output electrode OEP and the pixel input electrode IEP are disposed on the pixel activation layer ALP. The pixel output electrode OEP and the pixel input electrode IEP are spaced from each other. Each of the pixel output electrode OEP and the pixel input electrode IEP may partially overlap with the pixel control electrode CEP.

Although the pixel transistor TRP having a staggered structure is shown in FIG. 4 exemplarily, a structure of the pixel transistor TRP is not limited thereto. For example, in an embodiment, the pixel transistor TRP may have a planar structure.

A second insulating layer 20 covering the pixel activation part ALP, the pixel output electrode OEP, and the pixel input electrode IEP is disposed on the first insulating layer 10. The second insulating layer 20 may provide a flat surface. The second insulating layer 20 may include an organic material.

The pixel electrode PE is disposed on the second insulating layer 20. The pixel electrode PE is connected to the pixel output electrode OEP through the second insulating layer 20 and a contact hole CH penetrating the second insulating layer 20. An alignment layer 30 covering the pixel electrode PE may be disposed on the second insulating layer 20.

A color filter layer CF is disposed on a surface (e.g., one surface) of the second substrate DS2. The common electrode CE is disposed on the color filter layer CF. A common voltage is applied to the common electrode CE. A common voltage and a pixel voltage may have different values. In an embodiment, an alignment layer covering the common electrode CE may be disposed on the common electrode CE. In an embodiment, another insulating layer may be disposed between the color filter layer CF and the common electrode CE.

The pixel electrode PE and the common electrode CE with the liquid crystal layer LCL therebetween form the liquid crystal capacitor Clc. Additionally, portions of the pixel electrode PE and the storage line STL, which are disposed with the first insulating layer 10 and the second insulating layer 20 therebetween, form the storage capacitor Cst. The storage line STL receives a storage voltage having a different value from that of a pixel voltage. A storage voltage may have the same or substantially the same value as that of the common voltage.

On the other hand, a section of the pixel PXij shown in FIG. 4 is just one example. For example, in an embodiment, unlike those of FIG. 4, at least one of the color filter layer CF and the common electrode CE may be disposed on the first substrate DS1. That is, a liquid crystal display panel according to an embodiment of the inventive concept may include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 5:
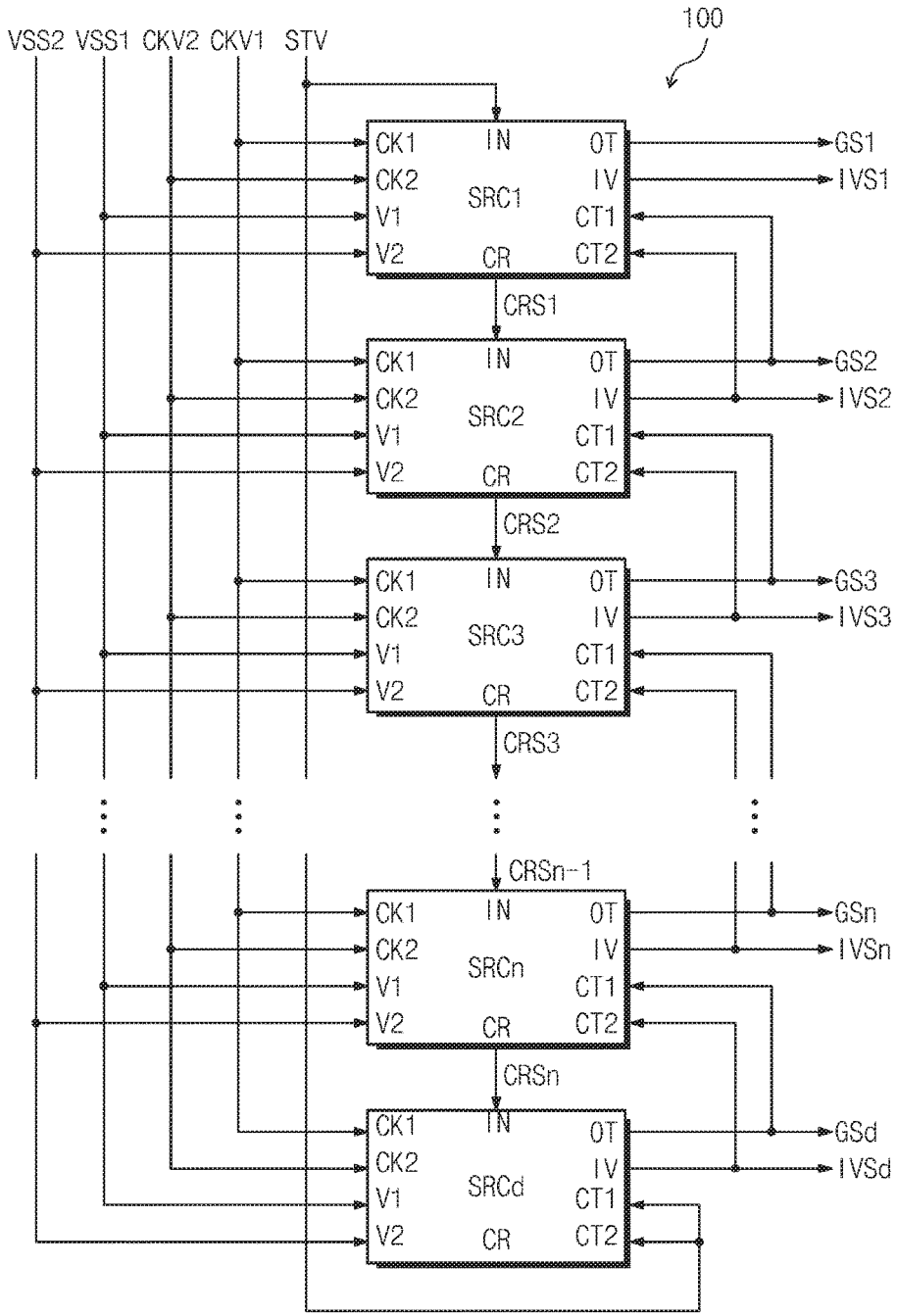
FIG. 5 is a block diagram illustrating a gate driving circuit according to an embodiment of the inventive concept.

FIG. 5 is a block diagram illustrating a gate driving circuit 100 according to an embodiment of the inventive concept. As shown in FIG. 5, a gate driving circuit 100 includes a plurality of stages SRC1 to SRCn. The plurality of stages SRC1 to SRCn may configure one shift register. As shown in FIG. 5, the plurality of stages SRC1 to SRCn may be connected in cascade to each other.

The plurality of stages SRC1 to SRCn are respectively connected to the plurality of gate lines GL1 to GLn. That is, the plurality of stages SRC1 to SRCn provide gate signals GS1 to GSn to the plurality of gate lines GL1 to GLn, respectively.

Each of the plurality of stages SRC1 to SRCn includes an input terminal IN, a first clock terminal CK1, a second clock terminal CK2, a first voltage input terminal V1, a second voltage input terminal V2, a first control terminal CT1, a second control terminal CT2, an inverter terminal IV, an output terminal OT, and a carry terminal CR.

The carry terminal CR of each of the plurality of stages SRC1 to SRCn is electrically connected to the input terminal IN of a next driving state. The input terminal IN of a first stage SRC1 receives a start signal STV for starting the drive of the gate driving circuit 100, instead of a carry signal of a previous stage. After the first stage, the input terminal IN of each of the plurality of stages SRC2 to SRCn receives a carry signal of a previous stage. For example, the input terminal IN of the ith stage is electrically connected to the carry terminal CR of the i−1th stage. Here, i is an integer greater than 1 and less than n. As shown in FIG. 5, the input terminals IN of the second stage SRC2 and the third stage SRC3 respectively receive the carry signals of the first stage SRC1 and the second stage SRC2.

Moreover, this is just one example, and the input terminal IN of the ith stage may be electrically connected to the carry terminal of any of a previous stage, for example, the carry terminal of the i−1th stage, the i−2th stage, or the i−3th stage. For example, the second stage SRC2 may receive a start signal that is different from the start signal received by the first stage SRC1, and the input terminal IN of the third stage SRC3 may receive the carry signal of the first stage SRC1.

The first clock terminal CK1 receives a first clock signal CKV1, and the second clock terminal CK2 receives a second clock signal CKV2 (or a clock bar signal). Each of the first clock signal CKV1 and the second clock signal CKV2 swings between a first clock voltage VCK1 (e.g., see FIG. 7) and a second clock voltage VCK2 (e.g., see FIG. 7). A phase difference between the first clock signal CKV1 and the second clock signal CKV2 may be about 180°. The first clock voltage VCK1 may be, for example, about 15V to about 35V. The second clock voltage VCK2 may be, for example, about −15V to about −13V.

The first control terminal CT1 of each of the plurality of stages SRC1 to SRCn is electrically connected to the output terminal OT of the next stage, and receives a gate signal of the next stage. For example, as shown in FIG. 5, the first control terminal CT1 of the first stage SRC1 is electrically connected to the output terminal OT of the second stage SRC2.

However, the first control terminal CT1 of the last driving stage SRCn from among the plurality of stages SRC1 to SRCn receives a signal corresponding to an output signal from a dummy stage SRCd. The dummy stage SRCd may be sequentially connected to an end (e.g., a rear end) of the last driving stage SRCn. However, the positions and number of the dummy stages SRCd may be variously changed according to the design of the gate driving circuit 100 as would be known to one skilled in the art.

The second control terminal CT2 of each of the plurality of stages SRC1 to SRCn is electrically connected to the inverter terminal IV of the next stage. For example, as shown in FIG. 5, the second control terminal CT2 of the first stage SRC1 is electrically connected to the inverter terminal IV of the second stage SRC2. However, the second control terminal CT2 of the last driving stage SRCn from among the plurality of stages SRC1 to SRCn receives a signal corresponding to an inverter signal from the dummy stage SRCd.

FIG. 5 is just an example of a gate driving circuit, and a connection relationship of the plurality of stages SRC1 to SRCn shown in FIG. 5 may be variously changed.

For example, unlike in FIG. 5, in an embodiment, the input terminals IN of the plurality of stages SRC1 to SRCn may respectively receive gate signals from the output terminals OT of previous stages. That is, carry signals or gate signals applied to the input terminals IN of the plurality of stages SRC1 to SRCn are one control signal for controlling an operation of the plurality of stages SRC1 to SRCn.

Additionally, unlike that of FIG. 5, in an embodiment, the first control terminal CT1 of each of the plurality of stages SRC1 to SRCn may be electrically connected to the carry terminal CR of the next stage, instead of the output terminal OT of the next stage, to receive a carry signal from the next stage.

A first low voltage VSS1 is applied to the first voltage input terminal V1 of each of the plurality of stages SRC1 to SRCn, and a second low voltage VSS2 that may be lower than the first low voltage VSS1 is applied to the second voltage input terminal V2 of each of the plurality of stages SRC1 to SRCn. The first low voltage VSS1 may be, for example, about −15 V to about −13 V, and the second low voltage VSS2 may be, for example, about −17 V to about −15 V. As one example, the first low voltage VSS1 may be −14 V and the second low voltage VSS2 may be about −16 V. The first low voltage VSS1 may have the same or substantially the same level as that of the second clock voltage VCK2.

The output terminal OT of each of the plurality of stages SRC1 to SRCn is connected to a corresponding gate line. Accordingly, a gate signal outputted through the output terminal OT is applied to the corresponding gate line.

Figure 6:
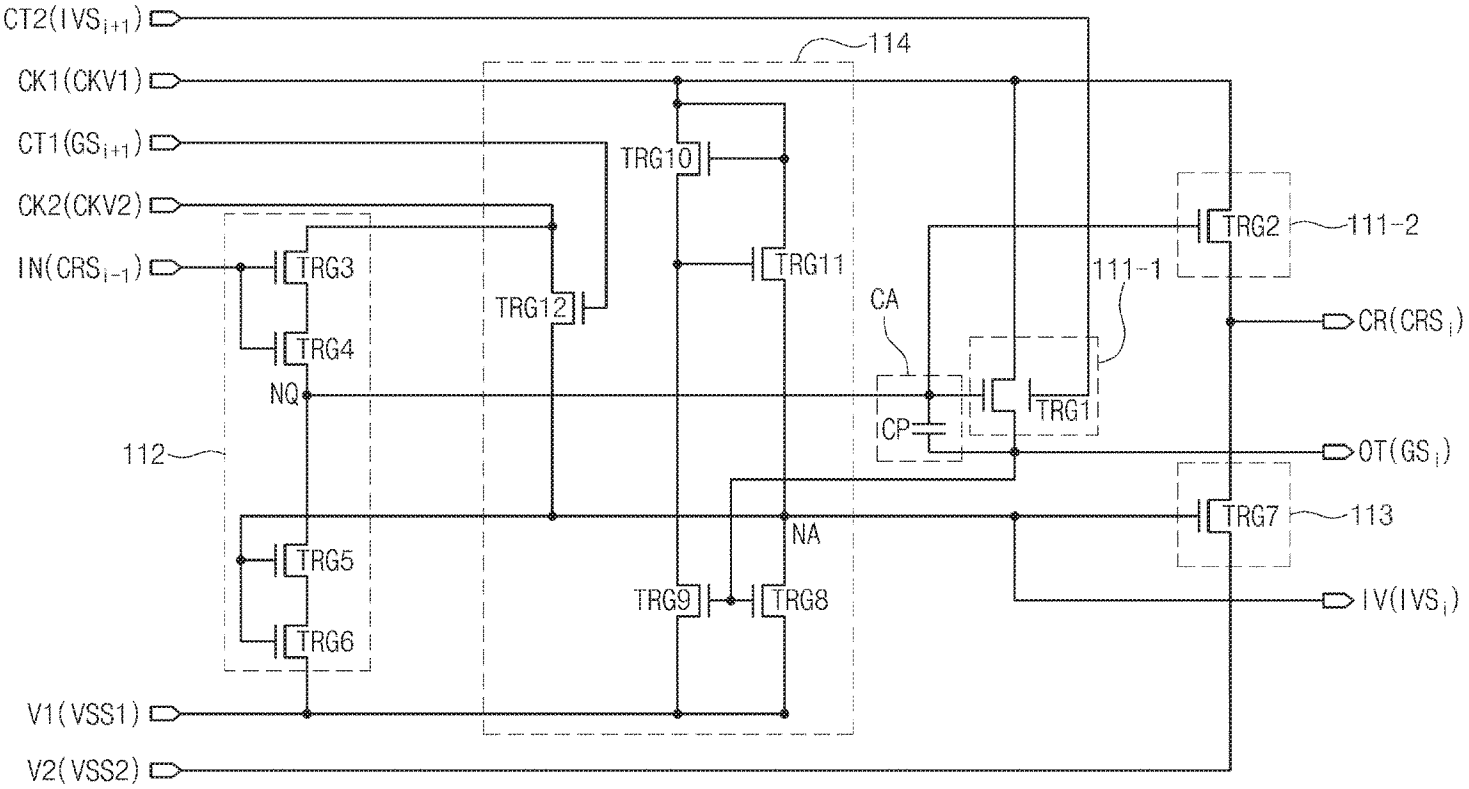
FIG. 6 is a circuit diagram illustrating an ith stage from among a plurality of stages shown in FIG. 5.
Figure 7:
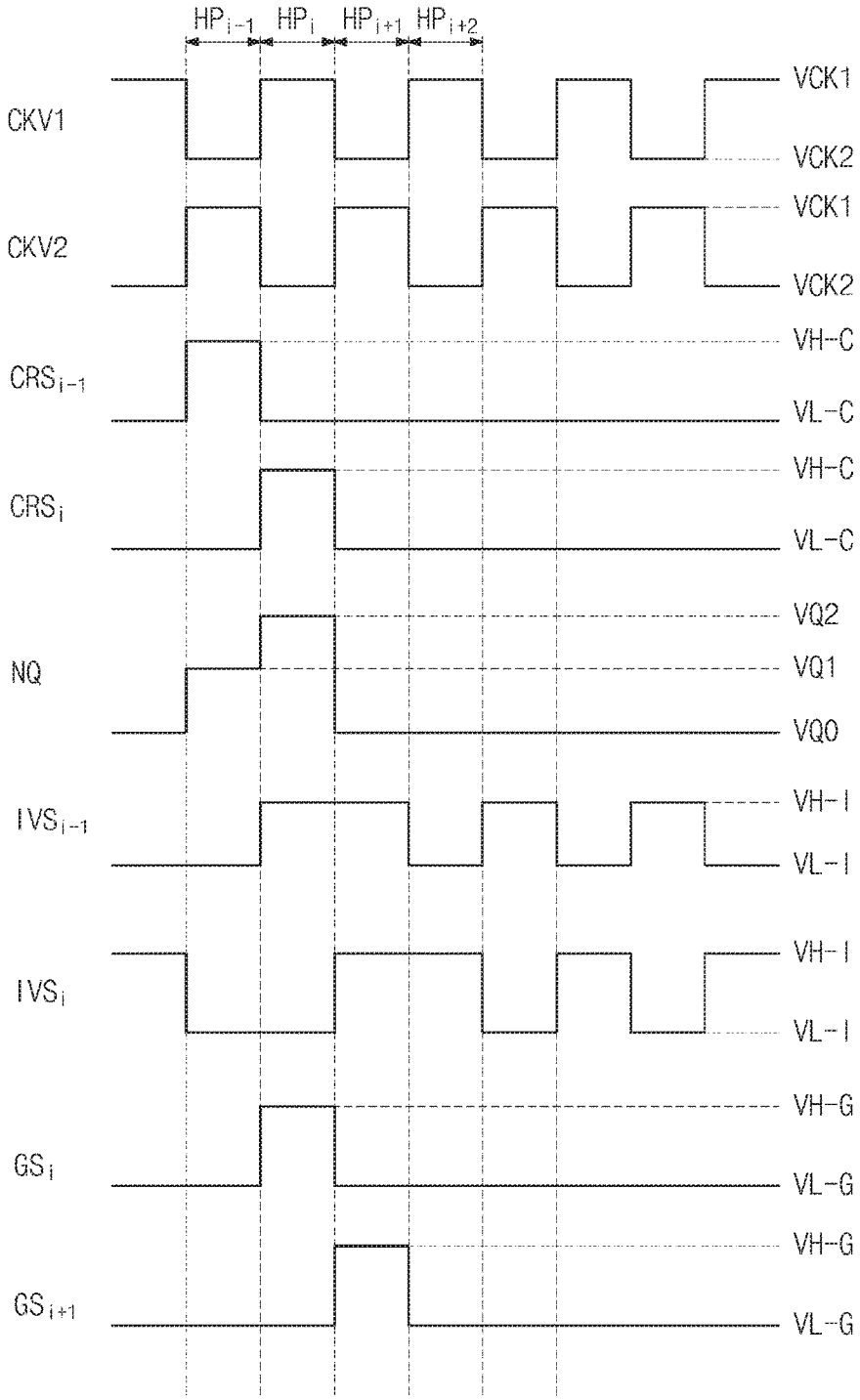
FIG. 7 is an input/output signal waveform diagram illustrating an ith stage shown in FIG. 6.

FIG. 6 is a circuit diagram illustrating an ith stage SRCi from among the plurality of stages SRC1 to SRCn shown in FIG. 5, and FIG. 7 is an input/output signal waveform diagram of the ith stage SRCi shown in FIG. 6. Each of the plurality of stages SRC1 to SRCn shown in FIG. 5 may have the same or substantially the same circuit configuration as that of the ith stage SRCi shown in FIG. 6.

The ith stage SRCi includes a first output unit 111-1, a second output unit 111-2, a charging unit CA, a control unit 112, a pull-down unit 113, and an inverter unit 114.

The first output unit 111-1 outputs a gate signal GSi to the ith gate line, and the second output unit 111-2 outputs a carry signal CRSi to the i+1th stage.

The charging unit CA is charged by a second clock signal CKV2 applied to a first node (NQ or Q-node) in response to the carry signal CRSi−1 of the i−1th stage.

The control unit 112 controls on/off operations of each of the first output unit 111-1 and the second output unit 111-2 by adjusting a voltage of the first node NQ. The control unit 112 turns on each of the first output unit 111-1 and the second output unit 111-2 in response to the carry signal CRSi−1 of the i−1th stage, and turns off each of the first output unit 111-1 and the second output unit 111-2 in response to an inverter signal IVSi outputted from the inverter unit 114 of the ith stage. The inverter signal IVSi includes a section for maintaining or substantially maintaining an inverter-high voltage VH-I, and a section for maintaining or substantially maintaining an inverter-low voltage VL-I. The inverter-high voltage VH-I is identical or substantially identical to the first clock voltage VCK1. The inverter-low voltage VL-I is identical or substantially identical to the first low voltage VSS1.

Then, the control unit 112 provides the first low voltage VSS1 to the first node NQ in response to a level of a second node (NA or A-node).

The pull-down unit 113 pulls down the potential of the carry terminal CR to the second low voltage VSS2.

The inverter unit 114 controls an operation of the pull-down unit 113. The inverter unit 114 provides an inverter signal to the second node NA in order to turn on/off the pull-down unit. Herein, the second node NA is a part where the inverter signal generated based on a clock signal is applied from the inverter unit 114, and is connected to the control electrode of the pull-down unit 113. Additionally, the second node NA is involved in applying the first low voltage VSS1 to the first node NQ.

Each of the gate signals GSi and GSi+1 includes a section for maintaining or substantially maintaining a gate-high voltage VH-G, and a section for maintaining or substantially maintaining a gate-low voltage VL-G. The gate-high voltage VH-G is identical or substantially identical to the first clock voltage VCK1. The gate-low voltage VL-G is identical or substantially identical to the first low voltage VSS1.

Each of the carry signals CRSi−1 and CRSi includes a section for maintaining or substantially maintaining a carry-high voltage VH-C, and a section for maintaining or substantially maintaining a carry-low voltage VL-C. The carry-high voltage VH-C is identical or substantially identical to the first clock voltage VCK1. The carry-low voltage VL-C is identical or substantially identical to the second low voltage VSS2.

Referring to FIGS. 6 and 7, a configuration of the ith stage SRCi will be described in more detail. FIG. 7 is a view illustrating a horizontal section HPi (hereinafter referred to as an ith horizontal section), where an ith gate signal GSi is outputted, a previous (e.g., an immediately previous) horizontal section HPi−1 (hereinafter referred to as an i−1th horizontal section), and a next (e.g., an immediately next) horizontal section HPi+1 (hereinafter referred to as an i+1th horizontal section), from among a plurality of horizontal sections.

The first output unit 111-1 includes a first output transistor TRG1. The first output transistor TRG1 includes an input electrode for receiving an applied clock signal CKV1, a first control electrode connected to the first node NQ, a second control electrode for receiving an applied inverter signal IVSi+1 outputted from an i+1th stage SRCi+1, and an output electrode connected to an output terminal OT. A first clock signal CKV1 is applied through a first clock terminal CK1. The gate signal GSi is outputted through the output terminal OT. The first node NQ is an output terminal of the control unit 112.

The second output unit 111-2 includes a second output transistor TRG2. The second output transistor TRG2 includes an input electrode for receiving the first clock signal CKV1, a control electrode connected to the first node NQ, and an output electrode connected to the carry terminal CR. The carry signal CRSi is outputted through the carry terminal CR.

The charging unit CA includes a capacitor CP. The capacitor CP is disposed between the first control electrode and the output electrode of the first output transistor TRG1. One end of the capacitor CP is connected to the first node NQ and the other end of the capacitor CP is connected to the output terminal OT.

The control unit 112 includes first to fourth control transistors TRG3, TRG4, TRG5, and TRG6.

The first control transistor TRG3 includes a control electrode for receiving an applied carry signal CRSi−1 outputted from the i-th stage SRCi−1, an input electrode for receiving an applied second clock signal CKV2, and an output electrode connected to an input electrode of the second control transistor TRG4.

The carry signal CRSi−1 of the i−1th stage is a control signal applied to the control electrode of the first control transistor TRG3.

The second control transistor TRG4 includes a control electrode connected to the control electrode of the first control transistor TRG3, the input electrode connected to the output electrode of the first control transistor TRG3, and an output electrode connected to the first node NQ. Additionally, the output electrode of the second control transistor TRG4 is connected to the first control electrode of the first output transistor TRG1, and to the control electrode of the second output transistor TRG2 through the first node NQ.

The third control transistor TRG5 includes a control electrode connected to the second node NA, an input electrode connected to an output electrode of the fourth control transistor TRG6, and an output electrode connected to the first node NQ.

The fourth control transistor TRG6 includes a control electrode connected to the control electrode of the third control transistor TRG5, an input electrode for receiving an applied voltage that is identical or substantially identical to the first low voltage VSS1, and the output electrode connected to the input electrode of the third control transistor TRG5.

The second control transistor TRG4 and the third control transistor TRG5 may prevent or substantially prevent current from leaking from the first node NQ toward the control unit 112. However, the inventive concept is not limited thereto, and in an example embodiment, the second control transistor TRG4 or the third control transistor TRG5 may be omitted. For example, when the second control transistor TRG4 is omitted, the output electrode of the first control transistor TRG3 may be directly connected to the first node NQ, and when the third control transistor TRG5 is omitted, the output electrode of the fourth control transistor TRG6 may be directly connected to the first node NQ.

When the first control transistor TRG3 and the second control transistor TRG4 are turned on in response to the carry signal CRSi−1 of the i−1th stage, the potential of the first node NQ is raised from a base voltage VQ0 to a first boosting voltage VQ1, and each of the first output transistor TRG1 and the second output transistor TRG2 are turned on. At this point, as the first output transistor TRG1 is turned on, the second clock voltage VCK2 of the first clock signal CKV1 may be applied from the first clock terminal CK1 to the output terminal OT. The base voltage VQ0 may be identical or substantially identical to the first low voltage VSS1.

When the carry signal CRSi−1 of the i−1th stage is applied to the first node NQ, the capacitor CP is charged. Then, the first output transistor TRG1 is bootstrapped. That is, the first node NQ connected to the control electrode of the first output transistor TRG1 is boosted from the first boosting voltage VQ1 to a second boosting voltage VQ2. The second boosting voltage VQ2 is greater than the first boosting voltage VQ1.

When the third control transistor TRG5 and the fourth control transistor TRG6 are turned on in response to the inverter signal IVSi, the potential of the first node NQ is reduced. When the potential of the first node NQ is reduced, each of the first and second output transistors TRG1 and TRG2 connected to the first node NQ are turned off.

The pull-down unit 113 includes a pull-down transistor TRG7. The pull-down transistor TRG7 provides the second low voltage VSS2 to the carry terminal CR in response to the inverter signal IVSi. The pull-down transistor TRG7 includes a control electrode connected to the second node NA to receive the inverter signal IVSi, an input electrode connected to the second voltage input terminal V2 to receive the second low voltage VSS2, and an output electrode connected to the carry terminal CR. The output electrode of the pull-down transistor TRG7 is connected to the output electrode of the second output transistor TRG2. However, the input electrode of the pull-down transistor TRG7 is connected to the second voltage input terminal V2 to receive an applied second low voltage VSS2.

That is, when the first node NQ is boosted to the second boosting voltage VQ2 during the ith horizontal section HPi, a level of the carry terminal CR becomes the carry-high voltage VH-C. Then, as the pull-down transistor TRG7 of the pull-down unit 113 is turned on by the inverter signal IVSi, it pulls down a level of the carry terminal CR to the carry-low voltage VL-C.

The inverter unit 114 includes first to fifth inverter transistors TRG8, TRG9, TRG10, TRG11, and TRG12.

The inverter unit 114 provides the first low voltage VSS1 to the second node NA in response to the gate signal GSi outputted from the first output unit 111-1. Then, the inverter unit 114 provides the first clock voltage VCK1 of the second clock signal CKV2 to the second node NA in response to the gate signal GSi+1 of the i+1th stage. The pull-down unit 113, which receives the first clock voltage VCK1 of the second clock signal CKV2, provides the second low voltage VSS2 to the carry terminal CR.

The inverter unit 114 outputs the inverter signal IVSi having the inverter-low voltage VL-I during each of the i−1th horizontal period HPi−−1 and the ith horizontal period HPi. The inverter unit 114 outputs the inverter signal IVSi having the inverter-high voltage VH-I during the i+1th horizontal period HPi+1. The inverter unit 114 outputs the inverter signal IVSi having the same or substantially the same waveform as that of the first clock signal CKV1 from an i+2th horizontal period HPi+2.

The first inverter transistor TRG8 includes an output electrode connected to the second node NA, a control electrode connected to the output terminal OT, and an input electrode connected to the first voltage input terminal V1 to receive the first low voltage VSS1.

The second inverter transistor TRG9 includes an output electrode connected to an output electrode of the third inverter transistor TRG10 and to a control electrode of the fourth inverter transistor TRG11, a control electrode connected to the output terminal OT, and an input electrode connected to the first voltage input terminal V1 to receive the first low voltage VSS1.

The third inverter transistor TRG10 includes a control electrode and an input electrode, where the first clock signal CKV1 is commonly applied. The output electrode of the third inverter transistor TRG10 is connected to the output electrode of the second inverter transistor TRG9 and to the control electrode of the fourth inverter transistor TRG11.

The fourth inverter transistor TRG11 includes an input electrode for receiving the first clock signal CKV1, the control electrode connected to the output electrode of the third inverter transistor TRG10, and an output electrode connected to the second node NA.

The fifth inverter transistor TRG12 includes a control electrode connected to the first control terminal CT1 to receive the gate signal GSi+1 of the i+1th stage, an input electrode connected to the second clock terminal CK2 to receive the second clock signal CKV2, and an output electrode connected to the second node NA. The control electrode of the fifth inverter transistor TRG12 is electrically connected to a second control electrode CEG1-2 (e.g., see FIG. 8) of a first output transistor of the i+1th stage through the second node NA.

The first inverter transistor TRG8 and the second inverter transistor TRG9 supply the first low voltage VSS1 to the second node NA in response to the gate signal GSi during the ith horizontal section HPi.

Accordingly, the pull-down transistor TRG7 is turned off by the first low voltage VSS1 during the ith horizontal section HPi.

During the i+1th horizontal period HPi+1, the fifth inverter transistor TRG12 provides the second clock signal CKV2 having the first clock voltage VCK1 to the second node NA in response to the gate signal GSi+1 of the i+1th stage. A voltage of the second node NA, which receives the first clock voltage VCK1, is increased.

As a voltage of the second node NA is increased, the pull-down transistor TRG7 is turned on. The turned-on pull-down transistor TRG7 provides the second low voltage VSS2 to the carry terminal CR.

Figure 8:
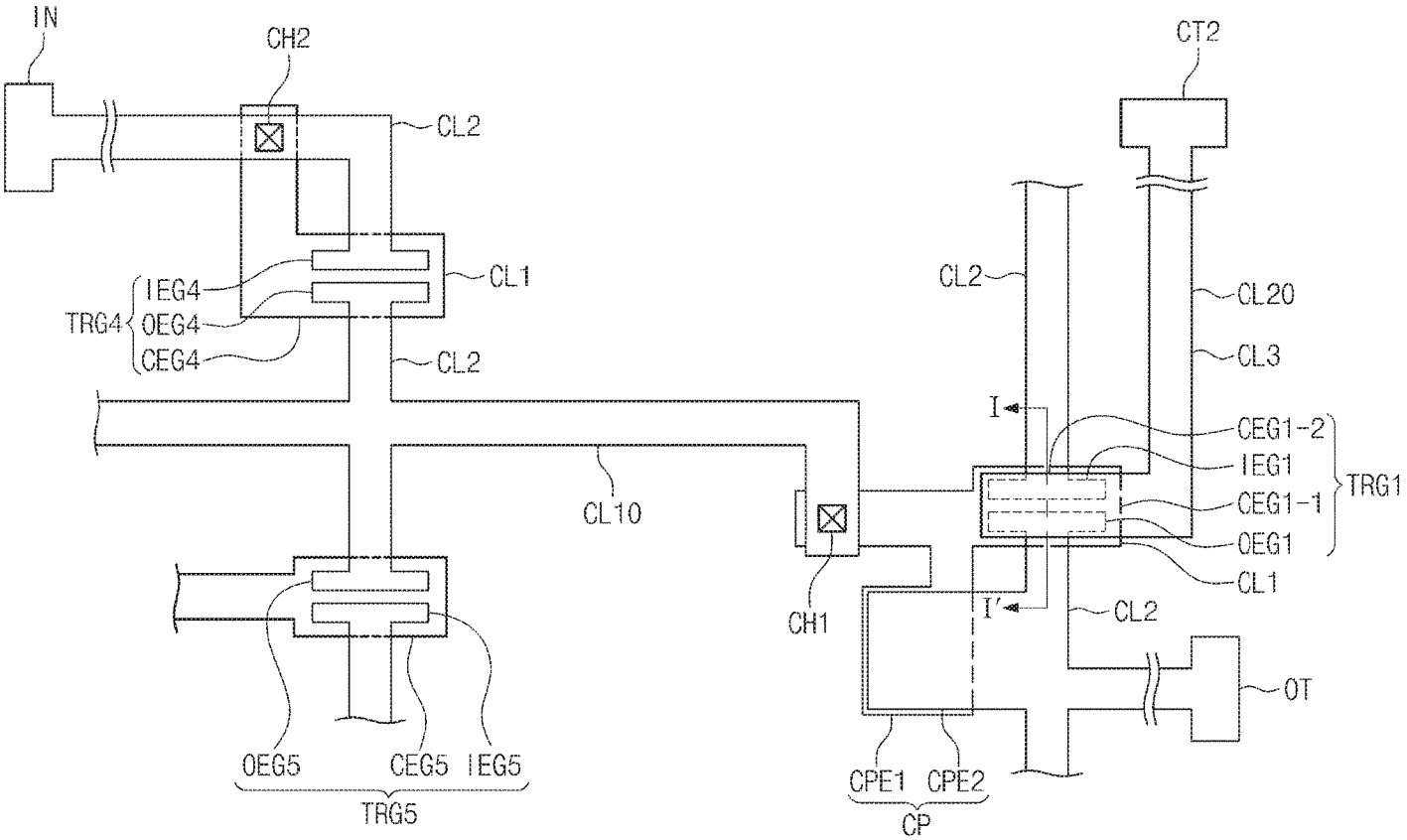
FIG. 8 is a view illustrating a layout of a part of an ith stage shown in FIG. 6.
Figure 9:
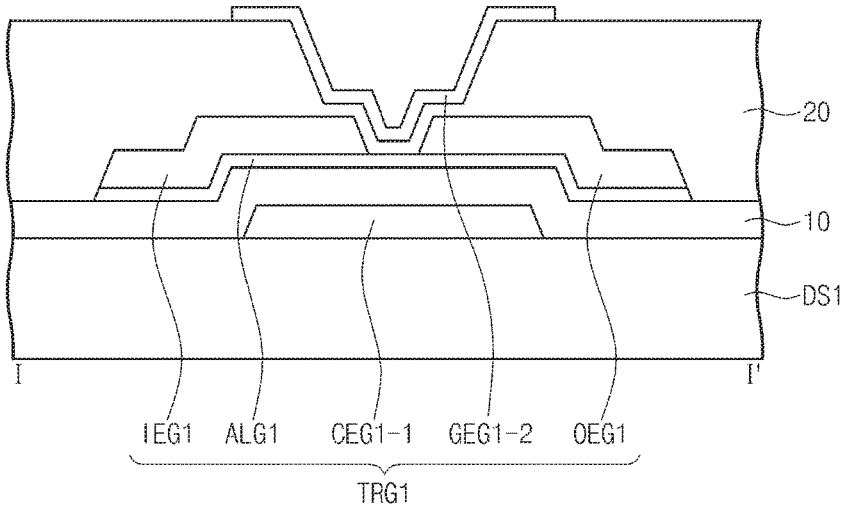
FIG. 9 is a sectional view along the line I-I' of FIG. 8.

FIG. 8 is a view illustrating a layout of a part of the ith stage SRCi shown in FIG. 6. FIG. 9 is a sectional view along the line I-I' of FIG. 8.

FIG. 8 illustrates the first output transistor TRG1, the second control transistor TRG4, and the third control transistor TRG5 of the ith driving stage SRCi (e.g., see FIG. 6) and a connection structure thereof.

In more detail, the ith driving stage SRCi includes a first conductive layer CL1, a second conductive layer CL2, a third conductive layer CL3, and an activation layer, which are disposed on different layers. The first conductive layer CL1, the second conductive layer CL2, and the third conductive layer CL3 may include a plurality of electrodes and wires. The activation layer includes a plurality of patterned parts. An insulating layer is disposed between each of the first conductive layer CL1, the second conductive layer CL2, and the third conductive layer CL3 (e.g., between the first conductive layer CL1 and the second conductive layer CL2, between the second conductive layer CL2 and the third conductive layer CL3, and between the first conductive layer CL1 and the third conductive layer CL3).

As shown in FIGS. 8 and 9, parts of the first conductive layer CL1 configure each of the first control electrode CEG1-1 of the first output transistor TRG1, the control electrode CEG4 of the second control transistor TRG4, and the control electrode CEG5 of the third control transistor TRG5.

Parts of the second conductive layer CL2 configure each of the input electrodes IEG1, IEG4, and IEG5 and output electrodes OEG1, OEG4, and OEG5 of the transistors TRG1, TRG4, and TRG5.

A part of the third conductive layer CL3 configures the second control electrode CEG1-2 of the first output transistor TRG1.

The second conductive layer CL2 may include a first wire CL10 for connecting the transistors TRG1, TRG4, and TRG5. The first wire CL10 corresponds to the first node NQ shown in FIG. 6. Additionally, the third conductive layer CL3 may include a second wire CL20 for connecting the second control electrode CEG1-2 of the first output transistor TRG1 to the second control terminal CT2.

The first control electrode CEG1-1 of the first output transistor TRG1 and the first wire CL10 may be connected through a first contact hole CH1 that penetrates an insulating layer between the first conductive layer CL1 and the second conductive layer CL2. The first control electrode CEG1-1 of the first output transistor TRG1 is connected to the first electrode CPE1 of the capacitor CP. The output electrode OEG1 of the first output transistor TRG1 is connected to the second electrode CPE2 of the capacitor CP.

The control electrode CEG4 of the second control transistor TRG4 may be connected to the input electrode IEG4 of the second control transistor TRG4 and to the input terminal IN through a second contact hole CH2 that penetrates an insulating layer between the first conductive layer CL1 and the second conductive layer CL2.

Referring to FIGS. 4 and 9, the first control electrode CEG1-1 of the first output transistor TRG1 is disposed on the same layer as that of the pixel control electrode CEP of the pixel transistor TRP. The first control electrode CEG1-1 of the first output transistor TRG1 may be formed of the same or substantially the same material and may have the same or substantially the same layer structure as those of the pixel control electrode CEP of the pixel transistor TRP.

The input electrode IEG1 and output electrode OEG1 of the first output transistor TRG1 are disposed on the same layer as that of the pixel input electrode IEP and pixel output electrode OEP of the pixel transistor TRP. The input electrode IEG1 and output electrode OEG1 of the first output transistor TRG1 are formed of the same or substantially the same material and have the same or substantially the same layer structure as those of the pixel input electrode IEP and pixel output electrode OEP of the pixel transistor TRP.

The first insulating layer 10 is disposed commonly with the same or substantially the same layer structure for the first output transistor TRG1 and the pixel transistor TRP.

The activation layer ALG1 of the first output transistor TRG1 is disposed on the same layer as that of the pixel activation layer ALP of the pixel transistor TRP. The activation layer ALG1 of the first output transistor TRG1 is formed of the same or substantially the same material and has the same or substantially the same layer structure as those of the pixel activation layer ALP of the pixel transistor TRP.

The first output transistor TRG1 further includes a second control electrode CEG1-2 when compared to the pixel transistor TRP. The second control electrode CEG1-2 is disposed to overlap with the first control electrode CEG1-1. The second control electrode CEG1-2 of the first output transistor TRG1 may be formed of the same or substantially the same material as that of the first control electrode CEG-1. The inverter signal IVSi+1 (see FIG. 6) of the i+1th stage is applied to the second control electrode CEG1-2 of the first output transistor TRG1.

Current flows in the activation layer ALG1 in response to a signal applied to the first control electrode CEG1-1 or to the second control electrode CEG1-2 of the first output transistor TRG1.

Figure 10:
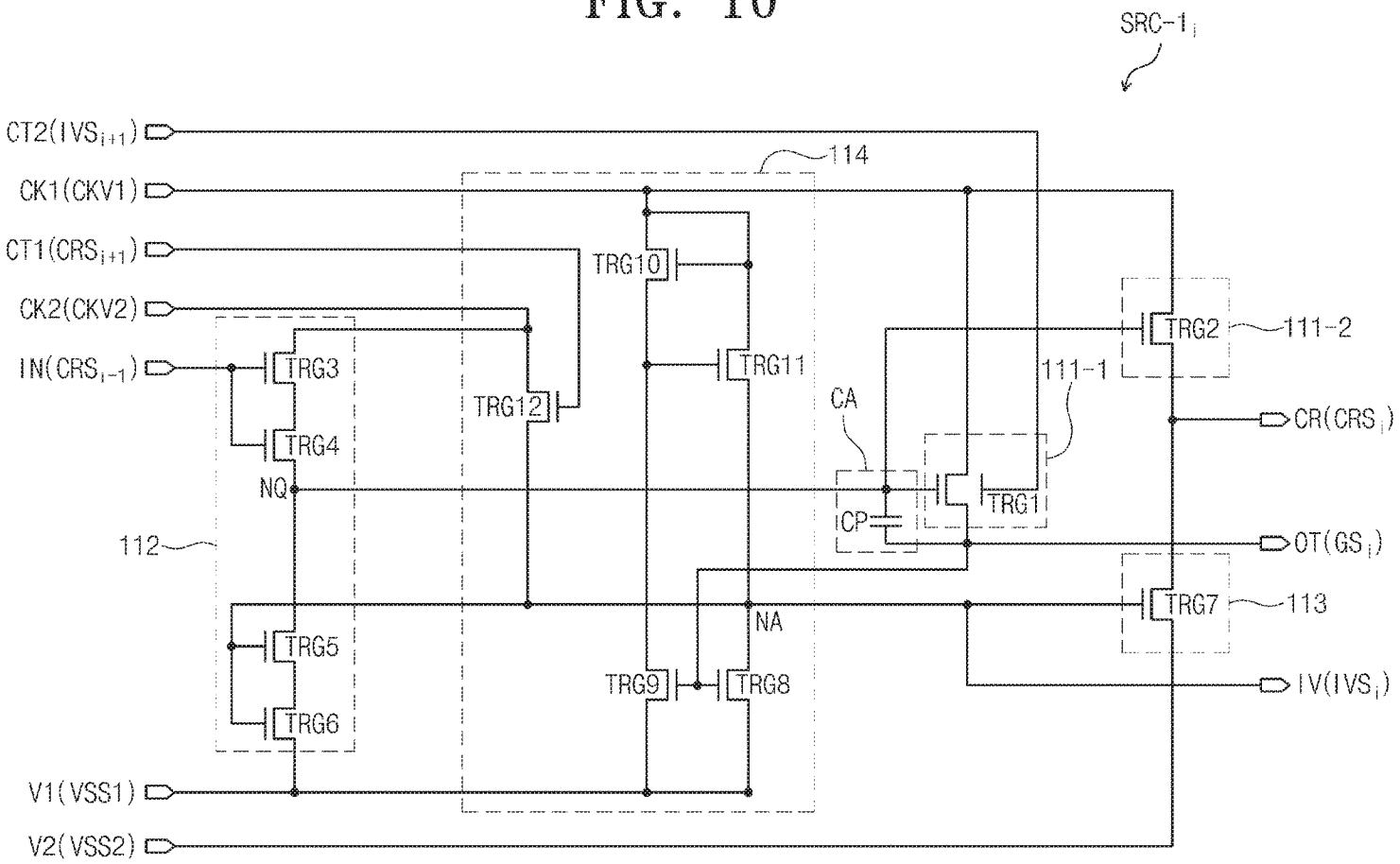
FIGS. 10, 11, and 12 are circuit diagrams illustrating an ith stage from among a plurality of stages included in a gate driving circuit according to one or more embodiments of the inventive concept.
Figure 11:
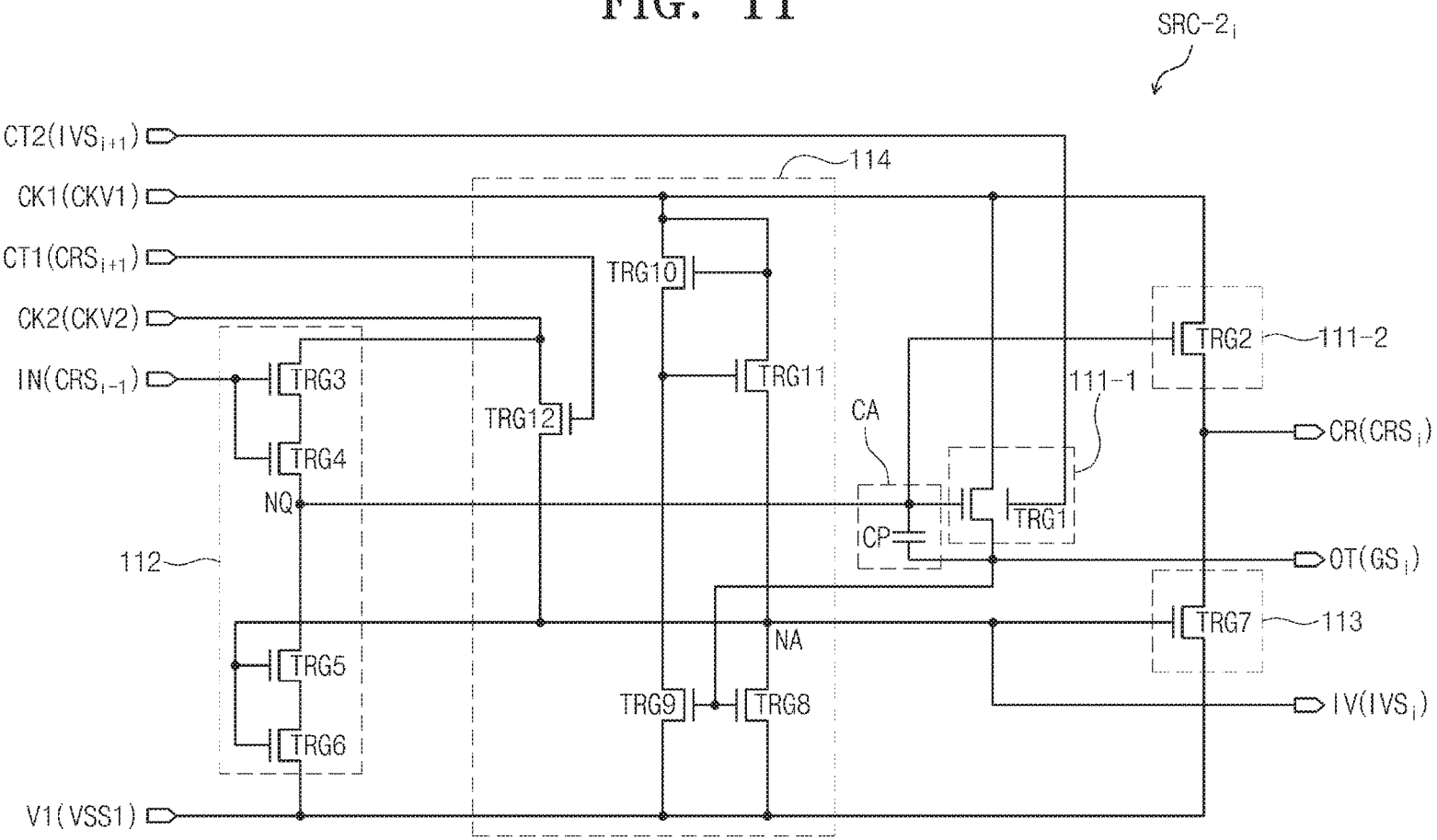
Figure 12:
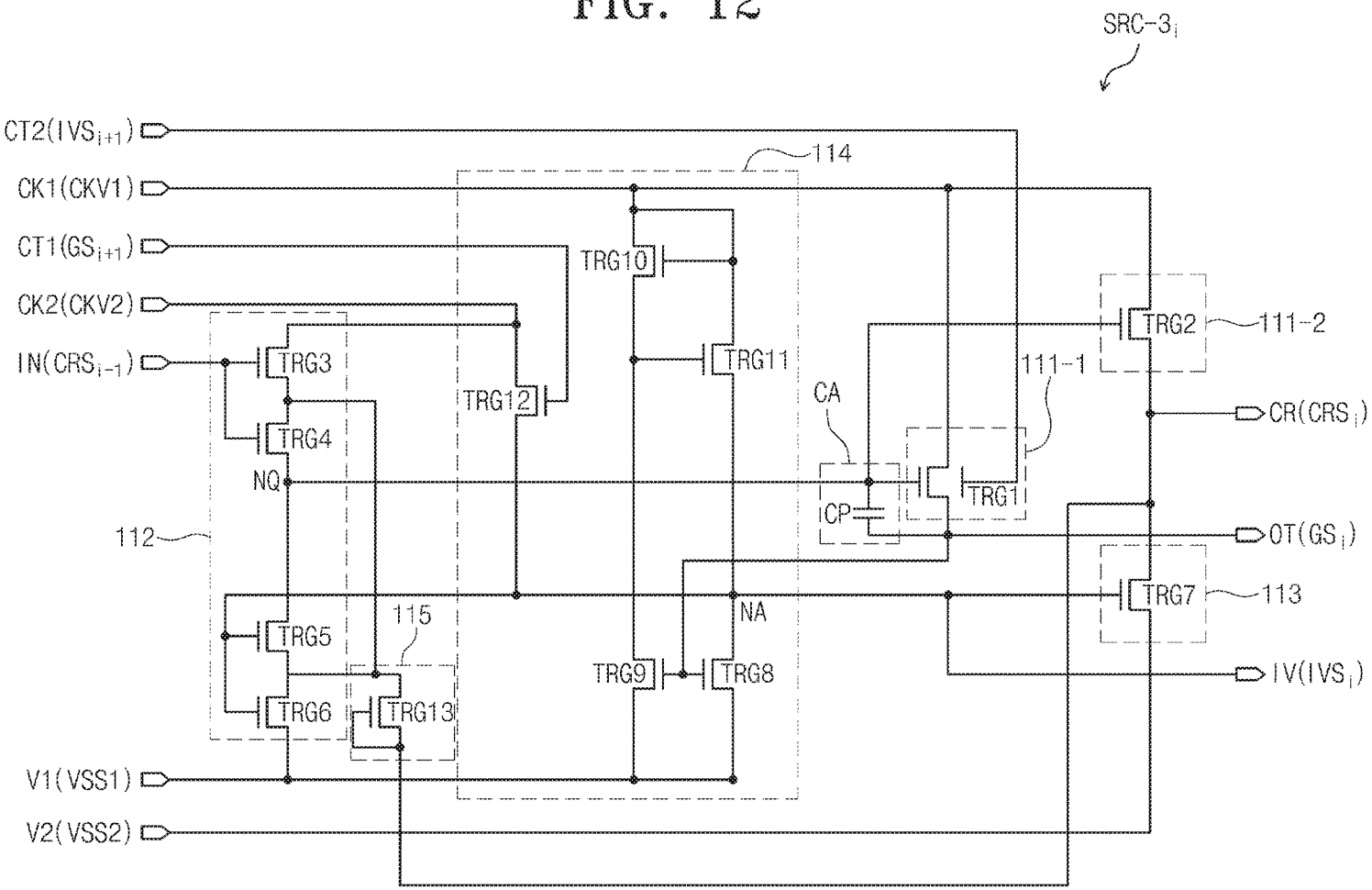

Each of FIGS. 10, 11, and 12 illustrates a circuit diagram of an ith stage from among a plurality of stages included in a gate driving circuit according to one or more embodiments of the inventive concept.

FIG. 10 is a circuit diagram of an ith stage SRC-1*i* according to an embodiment of the inventive concept. In relation to the ith stage SRC-1*i* shown in FIG. 10, a signal applied to the first control terminal CT1 is different from that of the ith stage SRCi shown in FIG. 6. The carry signal CRSi+1 of the i+1th stage is applied to the first control terminal CT1 of the ith stage SRC-1*i* shown in FIG. 10. Descriptions for the other parts are the same or substantially the same as to those for FIG. 6, and thus, are not repeated.

FIG. 11 is a circuit diagram of an ith stage SRC-2*i* according to an embodiment of the inventive concept. In relation to the ith stage SRC-2*i* shown in FIG. 11, a voltage applied to the input electrode of the pull-down transistor TRG7 is different from that of the ith stage SRC-1*i* shown in FIG. 10. The first low voltage VSS1 is applied to the input electrode of the pull-down transistor TRG7 in the ith stage SRC-2*i* shown in FIG. 11. Descriptions for the other parts are the same or substantially the same as to those for FIGS. 6 and 10, and thus, are not repeated.

FIG. 12 is a circuit diagram of an ith stage SRC-3*i* according to an embodiment of the inventive concept. The ith stage SRC-3*i* shown in FIG. 12 further includes a leakage current prevention unit 115 when compared to the ith stage SRCi shown in FIG. 6.

The leakage current prevention unit 115 includes a leakage current prevention transistor TRG13. The leakage current prevention transistor TRG13 includes a control electrode and an input electrode, which are commonly connected to the output electrode of the second output transistor TRG2. That is, the control electrode and input electrode of the second output transistor TRG2 are connected to each other (e.g., diode-connected), so that the second output transistor TRG2 operates as a diode. The leakage current prevention transistor TRG13 includes an output electrode connected to the output electrode of the first control transistor TRG3 and to the output electrode of the fourth control transistor TRG6.

The leakage current prevention unit 115 may prevent or substantially prevent leakage current from occurring from the first node NQ through the second control transistor TRG4 by applying a voltage (e.g., a high voltage) between the first control transistor TRG3 and the second control transistor TRG4. Additionally, the leakage current prevention unit 115 may prevent leakage current from occurring from the first node NQ through the third control transistor TRG5 by applying a voltage (e.g., a high voltage) between the third control transistor TRG5 and the fourth control transistor TRG6.

According to one or more embodiments of the inventive concept, as the number of transistors included in a gate driving circuit is reduced, the size of the gate driving circuit may be reduced. Additionally, the size of a bezel may be reduced in a display device including the gate driving circuit.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

Although exemplary embodiments of the present invention have been described, it is understood that the present invention should not be limited to these exemplary embodiments, and that various changes and modifications can be made by one having ordinary skill in the art within the spirit and scope of the present invention as defined in the following claims, and their equivalents.

What is claimed is:

1. A gate driving circuit comprising a plurality of stages configured to output gate signals to gate lines, respectively, and connected to each other in cascade, an ith stage, where i is an integer greater than or equal to two, from among the plurality of stages comprising:

a first output unit comprising a first output transistor comprising a first control electrode, a second control electrode overlapping with the first control electrode, an input electrode, and an output electrode, the first output unit being configured to generate a gate signal having a gate-off voltage lower than a gate-on voltage from a first clock signal applied to the input electrode of the first output transistor in response to a second signal applied to the second control electrode of the first output transistor to output a gate signal to the output electrode of the first output transistor and to maintain the gate signal at the gate-off voltage, after the gate signal having the gate-on voltage is outputted to the output electrode of the first output transistor from the first clock signal applied to the input electrode of the first output transistor in response to a first signal applied to the first control electrode of the first output transistor;

a control unit configured to control a voltage of a first node connected to the first control electrode of the first output transistor; and an inverter unit configured to output, to a second node, an inverter signal that swings between an inverter-low voltage and an inverter-high voltage higher than the inverter-low voltage, when the gate signal having the gate-on voltage is outputted from the first output unit to allow a voltage of the inverter signal to be at the inverter-low voltage, and when the gate signal having the gate-off voltage is outputted from the first output unit in response to the second signal to allow the voltage of the inverter signal to be at the inverter-high voltage.

2. The gate driving circuit of claim 1, wherein the second signal is an inverter signal outputted from an inverter unit of an i+1th stage.

3. The gate driving circuit of claim 2, wherein the inverter unit of the ith stage comprises an inverter transistor, the inverter transistor comprising:

a control electrode configured to receive an gate signal outputted from a first output unit of an i+1th stage;

an input electrode configured to receive a second clock signal having a phase difference of 180° with respect to the first clock signal; and an output electrode connected to the second node.

4. The gate driving circuit of claim 1, wherein the ith stage further comprises a second output unit comprising a second output transistor, the second output transistor comprising:

a control electrode connected to the first node;

an input electrode configured to receive the first clock signal; and an output electrode configured to output, to a carry output terminal of the ith stage, a carry signal having a carry-on voltage generated from the first clock signal.

5. The gate driving circuit of claim 4, wherein the ith stage further comprises a pull-down unit configured to provide a carry-off voltage lower than the carry-on voltage to the carry output terminal of the ith stage after the carry signal having the carry-on voltage is outputted.

6. The gate driving circuit of claim 5, wherein the gate-off voltage is higher than the carry-off voltage.

7. The gate driving circuit of claim 6, wherein the gate-off voltage is higher than about −15 V and lower than about −13 V, and the carry-off voltage is higher than about −17 V and lower than about −15 V.

8. The gate driving circuit of claim 5, wherein the inverter unit of the ith stage comprises an inverter transistor, the inverter transistor comprising:

a control electrode configured to receive a carry signal outputted from a second output unit of an i+1th stage;

an input electrode configured to receive a second clock signal having a phase difference of 180° with respect to the first clock signal; and an output electrode connected to the second node.

9. The gate driving circuit of claim 8, wherein the gate-off voltage is higher than the carry-off voltage.

10. The gate driving circuit of claim 8, wherein the gate-off voltage is substantially equal to the carry-off voltage.

11. The gate driving circuit of claim 4, wherein the control unit comprises a first control transistor, a second control transistor, a third control transistor, and a fourth control transistor, and wherein:

the first control transistor comprises a control electrode configured to receive an carry signal outputted from a second output unit of an i−1th stage, an input electrode configured to receive a second clock signal having a phase difference of 180° with respect to the first clock signal, and an output electrode connected to an input electrode of the second control transistor;

the second control transistor comprises a control electrode connected to the control electrode of the first control transistor, the input electrode connected to the output electrode of the first control transistor, and an output electrode connected to the first node;

the third control transistor comprises a control electrode connected to the second node, an input electrode connected to an output electrode of the fourth control transistor, and an output electrode connected to the first node; and the fourth control transistor comprises a control electrode connected to the control electrode of the third control transistor, an input electrode configured to receive a voltage that is substantially equal to the inverter-low voltage, and the output electrode connected to the input electrode of the third control transistor.

12. The gate driving circuit of claim 11, wherein the ith stage further comprises a leakage current prevention unit comprising a leakage current prevention transistor, the leakage current prevent transistor comprising:

a control electrode connected to the output electrode of the second output transistor;

an input electrode connected to the control electrode of the leakage current prevention transistor; and an output electrode connected to the output electrode of the first control transistor and to the output electrode of the fourth control transistor.

13. A display device comprising:

a display panel comprising a plurality of gate lines, a plurality of data lines crossing and insulated from the plurality of gate lines, and a plurality of pixels respectively connected to corresponding gate lines and corresponding data lines;

a data driver configured to provide data signals to the plurality of data lines; and a gate driver comprising a plurality of stages connected in cascade to each other and configured to provide gate signals to the plurality of gate lines, an ith stage, where i is an integer greater than or equal to two, from among the plurality of stages comprising:

a first output unit comprising a first output transistor comprising a first control electrode, a second control electrode overlapping with the first control electrode, an input electrode, and an output electrode, the first output unit being configured to generate a gate signal having a gate-off voltage lower than a gate-on voltage from a first clock signal applied to the input electrode of the first output transistor in response to a second signal applied to the second control electrode of the first output transistor to output a gate signal to the output electrode of the first output transistor and to maintain the gate signal at the gate-off voltage, after the gate signal having the gate-on voltage is outputted to the output electrode of the first output transistor from the first clock signal applied to the input electrode of the first output transistor in response to a first signal applied to the first control electrode of the first output transistor;

a control unit configured to control a voltage of a first node connected to the first control electrode of the first output transistor; and an inverter unit configured to output, to a second node, an inverter signal that swings between an inverter-low voltage and an inverter-high voltage higher than the inverter-low voltage, when the gate signal having the gate-on voltage is outputted from the first output unit to allow a voltage of the inverter signal to be at the inverter-low voltage, and when the gate signal having the gate-off voltage is outputted from the first output unit in response to the second signal to allow the voltage of the inverter signal to be at the inverter-high voltage.

14. The display device of claim 13, wherein the second signal is an inverter signal outputted from an inverter unit of an i+1th stage.

15. The display device of claim 14, wherein the inverter unit of the ith stage comprises an inverter transistor, the inverter transistor comprising:

a control electrode configured to receive an gate signal outputted from a first output unit of an i+1th stage;

an input electrode configured to receive a second clock signal having a phase difference of 180° with respect to the first clock signal; and an output electrode connected to the second node.

16. The display device of claim 13, wherein the ith stage further comprises a second output unit comprising a second output transistor, the second output transistor comprising:

a control electrode connected to the first node;

an input electrode configured to receive the first clock signal; and an output electrode configured to output, to a carry output terminal of the ith stage, a carry signal having a carry-on voltage generated from the first clock signal.

17. The display device of claim 16, wherein the ith stage further comprises a pull-down unit configured to provide a carry-off voltage lower than the carry-on voltage to the carry output terminal of the ith stage after the carry signal having the carry-on voltage is outputted.

18. The display device of claim 17, wherein the gate-off voltage is higher than the carry-off voltage.

19. The display device of claim 18, wherein the gate-off voltage is higher than about −15 V and lower than about −13 V, and the carry-off voltage is higher than about −17 V and lower than about −15 V.

20. A gate driving circuit comprising a plurality of stages configured to output gate signals to gate lines, respectively, and connected in cascade with each other, each of the plurality of stages comprising an output transistor, an inverter transistor, and a control transistor, and an output transistor of one stage from among the plurality of stages comprising:

a first control electrode electrically connected to a first node of the one stage;

a second control electrode electrically connected to an output electrode of an inverter transistor of a previous stage of the one stage;

an input electrode configured to receive a first clock signal that swings between a first clock voltage and a second clock voltage; and an output electrode configured to transfer a gate signal generated from the first clock signal, wherein an inverter transistor of the one stage comprises:

a control electrode electrically connected to an output electrode of an output transistor of the next stage of the one stage;

an input electrode configured to receive a second clock signal having a phase difference of 180° with respect to the first clock signal; and an output electrode electrically connected to a second control electrode of the output transistor of the next stage, and wherein a control transistor of the one stage comprises:

a control electrode electrically connected to an output electrode of an output transistor of the previous stage;

an input electrode configured to receive the second clock signal; and an output electrode electrically connected to the first node.

* * * * *